US006338763B1

(12) United States Patent
Hashimura et al.

(10) Patent No.: US 6,338,763 B1
(45) Date of Patent: Jan. 15, 2002

(54) STEEL WIRE FOR HIGH-STRENGTH SPRINGS AND METHOD OF PRODUCING THE SAME

(75) Inventors: Masayuki Hashimura; Hiroshi Hagiwara; Takanari Miyaki, all of Muroran; Hiroaki Hayashi, Narashino; Shoichi Suzuki, Narashino; Ikuo Ochiai, Narashino, all of (JP)

(73) Assignees: Nippon Steel Corporation; Suzuki Metal Industry Co., Ltd., both of Tokyo (JP)

( * ) Notice: Subject to any disclaimer, the term of this patent is extended or adjusted under 35 U.S.C. 154(b) by 0 days.

(21) Appl. No.: 09/407,103

(22) Filed: Sep. 27, 1999

(30) Foreign Application Priority Data

Oct. 1, 1998 (JP) ..... 10-280168
Apr. 9, 1999 (JP) ..... 11-103305

(51) Int. Cl.[7] ..... C21D 9/02; C21D 9/52; C22C 38/24; C22C 38/46

(52) U.S. Cl. ..... 148/333; 148/334; 148/335; 148/908; 148/580; 148/595

(58) Field of Search ..... 148/908, 580, 148/595, 333, 334, 335

(56) References Cited

U.S. PATENT DOCUMENTS 4,842,818 A 6/1989 Kato et al.
4,909,866 A * 3/1990 Abe et al. ..... 148/908

FOREIGN PATENT DOCUMENTS

| | | |
|---|---|---|
| DE | AS1182439 | 11/1964 |
| DE | 3124977 | 6/1981 |
| EP | 657557 | 6/1995 |
| RU | 0973659 | * 11/1982 |

* cited by examiner

*Primary Examiner*—Deborah Yee
(74) *Attorney, Agent, or Firm*—Kenyon & Kenyon

(57) ABSTRACT

This invention provides an oil-tempered wire having high strength (tensile strength of not less than 1960 MPa) and excellent workability and specifically provides a steel wire for high-strength springs comprising as steel components, in weight percent,

| | |
|---|---|
| C | 0.4–0.7% |
| Si | 1.2–2.5% |
| Mn | 0.1–0.5% |
| Cr | 0.4–2.0% |
| Al | 0.0001–0.005%, and being limited to |
| P | not more than 0.015% and |
| S | not more than 0.015%, |

the balance being Fe and unavoidable impurities, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%. This invention also provides a method of producing the steel wire.

6 Claims, 4 Drawing Sheets

STEEL WIRE FOR HIGH-STRENGTH SPRINGS AND METHOD OF PRODUCING THE SAME

BACKGROUND OF THE INVENTION

1. Field of the Invention

The present invention relates to a spring steel and a method for production thereof, particularly to a spring steel suitable for fabricating high-strength coil springs for use in vehicles and general machinery.

2. Description of the Related Art

Today's increasingly compact, high-performance vehicles and machines must be equipped with stronger springs. Particularly important to spring performance are fatigue resistance and permanent fatigue resistance. Coil springs are fabricated by either hot or cold coiling. Cold coiling is, however, generally adopted for springs requiring not only high strength but also small wire diameter, such as those used in vehicle engine valves. Recently, cold coiling is being used increasingly even for springs of large wire diameter such as suspension springs. The conventional practice in cold-coiled springs has been to use an oil-tempered wire made of a Si—Mn system or Si—Cr system spring steel such as set out in JIS G 4801. Moreover, as taught by, for example, JP-A-(unexamined published Japanese patent application)1-83644 or JP-A-2-57637, in order obtain still higher strength, the practice has been to use oil-tempered steel wire obtained by adding Mo, V and the like to the aforesaid base spring steel.

It is known that fatigue resistance and permanent fatigue resistance can generally be improved by increasing the tensile strength and hardness of the spring steel. In the case of a high-strength spring with tensile strength exceeding 1960 MPa, however, types of fracture not observed in conventionally used low-strength steels, such as fatigue failure originating at nonmetallic inclusions and intergranular fracture, occur with high frequency. In the case of a spring subjected to cold forming, moreover, the workability (spring fabricability) of the oil-tempered wire used as the material becomes an important factor. Specifically, when an oil-tempered wire is used to fabricate a coil spring by cold forming, breakage occurs during coiling if the tensile strength of the oil-tempered wire is high, because of the low fracture strain (fracture strain means "brittleness" of the steel in the present invention).

JP-A-4-247824 teaches that warm coiling is effective for achieving both high strength and good coiling property. This method has, however, been found to be disadvantageous in productivity and operability compared with the commonly used cold coiling method. JP-A-3-162550 asserts that breakage can be prevented by taking advantage of residual austenite to relieve strain by the working-induced transformation that occurs during coiling. The effect of the amount of residual austenite is, however, not certain. While the elongation value is found to increase with increasing amount of residual austenite in a tensile test, the bending angle of a notched test sample in a bending test is found to be unaffected by, or even to increase with, increasing amount of residual austenite.

SUMMARY OF THE INVENTION

An object of the present invention is to provide a steel wire for high-strength springs that has both high strength and good spring fabricability. Another object of the present invention is to provide a method of producing the steel wire.

A high strength of 1960 MPa or greater is indispensable for improving spring fatigue strength and permanent fatigue resistance. One particular technique frequently adopted recently for obtaining high strength is a nitriding treatment. A high nitriding temperature of 380–580° C. is used. In such cases, the temper-softening resistance is usually increased by adding V, Mo, Ti, Nb or the like in addition to conventional C and Si. Such elements are also added in the present invention.

Even in a simple fatigue test, a spring fabricated of a strength-enhanced steel whose tensile strength exceeds 1960 MPa fractures through a different fracture mechanism from that of conventional steels. Characteristically, compared with conventional steels, fractures more often originate from smaller nonmetallic inclusions or occur as intergranular fractures. It is therefore important to reduce the size of nonmetallic inclusions that can become fracture starting points, to clean the grain boundaries so as to increase intergranular strength, and, particularly, to lower the content of P and S, which are elements that reduce intergranular strength by segregating at the grain boundaries.

Addition of the aforesaid alloying elements to obtain high-strength usually degrades spring fabricability to an unacceptable level. The oil-tempered wire widely used as the material for high-strength cold-formed springs is produced by strand processing in which steel drawn into wire is continuously quenched and tempered. This strand processing is characterized by enabling quenching/tempering to be carried out efficiently in a very short heat-treatment period but tends to result in undissolved carbonitrides remaining in the matrix because the heating period for putting the alloying elements into solid solution is shorter than the heat-treatment period of a hot-formed spring. As these carbonitrides become nuclei for crystal grain formation during recrystallization, they refine the crystal grain boundaries and increase the yield strength. As the yield point rises, the fracture strain falls and notch sensitivity increases. This led to the discovery that cold spring fabricability can therefore be improved by reducing the amount of carbonitrides not entering solid solution. For this it is effective to lower the yield point while controlling carbonitrides during the actual heat-treatment period.

Addition of the aforesaid alloying elements also usually causes residual austenite to remain at the segregation sites and in the vicinity of the old austenite grain boundaries. In some cases residual austenite enhances ductility by relieving strain energy through working-induced transformation but it generally degrades workability in actual cold coiling. Although residual austenite becomes martensite through working-induced transformation, induced transformation occurring during spring fabrication produces local sites of high hardness in the steel. When bruises and scratches arising during handling or other such unavoidable small surface flaws occur, the vicinities of the flaws transform into high-hardness martensite portions and cause extreme local brittleness. It was discovered that these local points of high hardness degrade coiling performance by becoming defects that lead to breakage during spring coiling. In cold coiling of high-strength steel, it is therefore effective to improve workability by minimizing residual austenite and suppressing generation of working-induced martensite.

Therefore, in one of its aspects, the present invention provides:

(1) A steel wire for high-strength springs comprising as steel components, in weight percent,

| | |
|---|---|
| C | 0.4–0.7% |
| Si | 1.2–2.5% |
| Mn | 0.1–0.5% |
| Cr | 0.4–2.0% and |
| Al | 0.0001–0.005%, and |
| | being limited to |
| P | not more than 0.015% and |
| S | not more than 0.015%, |

the balance being Fe and unavoidable impurities, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

In another of its aspects, the present invention provides:

(2) A steel wire for high-strength springs comprising as steel components, in weight percent,

| | |
|---|---|
| C | 0.4–0.7% |
| Si | 1.2–2.5% |
| Mn | 0.1–0.5% |
| Cr | 0.4–2.0% and |
| Al | 0.0001–0.005%, and |
| V | 0.050–0.4%, |
| | Mn + V being not more than 0.6%, |
| | being limited to |
| P | not more than 0.015% and |
| S | not more than 0.015%, |

the balance being Fe and unavoidable impurities, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

In another of its aspects, the present invention provides:

(3) A steel wire for high-strength springs according to (1) or (2) above comprising in addition to the defined chemical components, in weight percent, Ni: 0.1–2.0%, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

In another of its aspects, the present invention provides:

(4) A steel wire for high-strength springs according to any of (1) to (3) above comprising in addition to the defined chemical components, in weight percent, Mo: 0.1–2.0%, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

In another of its aspects, the present invention provides:

(5) A steel wire for high-strength springs according to any of (1) to (4) above comprising in addition to the defined chemical components, in weight percent,

| | |
|---|---|
| Nb: | 0.005–0.05% and |
| Ti: | 0.005–0.05%, |

the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

In another of its aspects, the present invention provides:

(6) A method of producing a steel wire for high-strength springs comprising a step of subjecting a steel of the chemical composition defined in any of (1) to (5) above to heat treatment at a heating temperature of not less than 920° C. and a temperature of the wire at quenching of not greater than 45° C. to obtain a steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6%.

DESCRIPTION OF THE PREFERRED EMBODIMENTS

Figure 1:
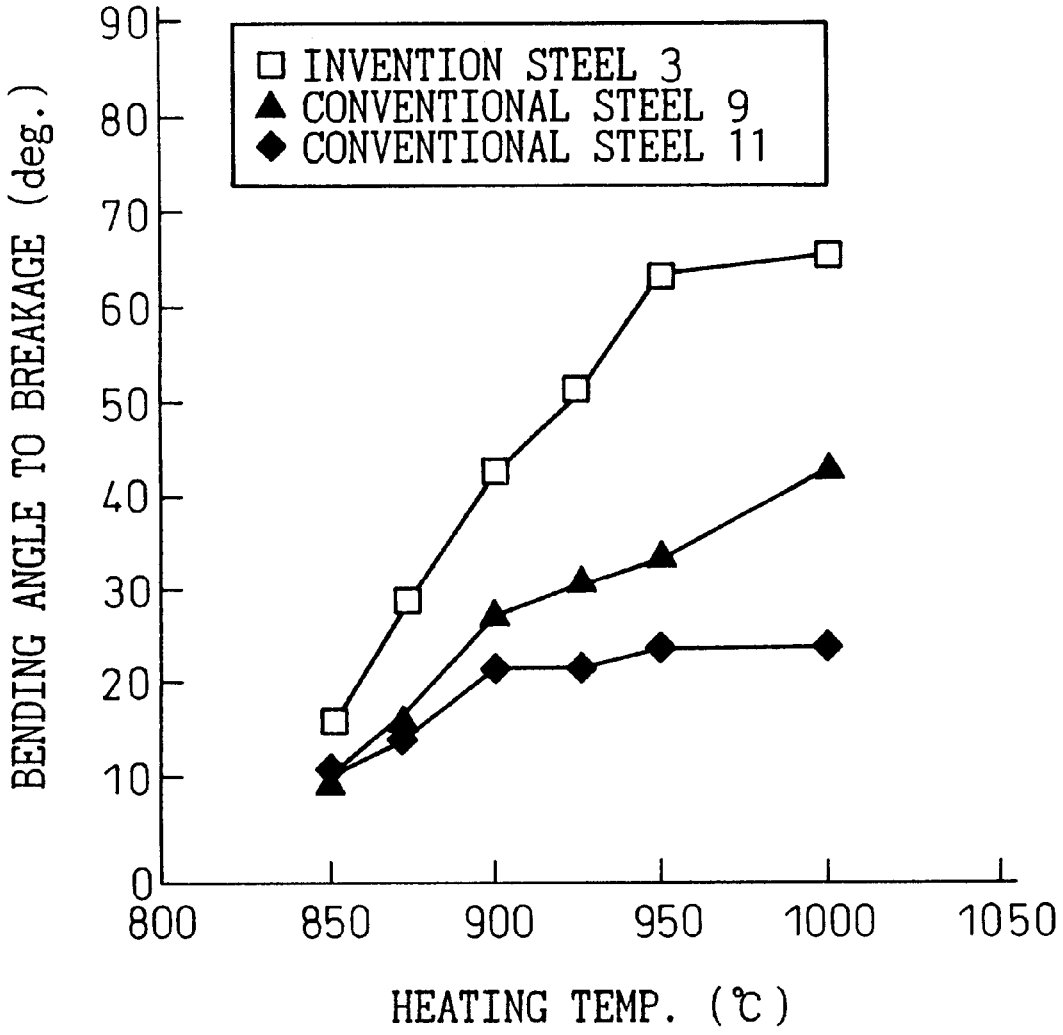
FIG. 1 is a graph showing how bending workability varies as a function of heating temperature.

The inventors invented a steel wire that meets both the requirement for high-strength and the requirement for workability after quenching/tempering, and also invented a method of producing the steel wire. These inventions will now be explained in detail. All percentage values are weight percent unless it is explicitly stated otherwise.

Carbon (C) is an element that greatly affects basic strength. Its content is defined as 0.4–0.7% in order to secure sufficient strength. At a content of less than 0.4%, a tensile strength of 1960 MPa or greater cannot be obtained. The upper limit is defined as 0.7% percent because a content in excess of 0.7% produces a near hypereutectic state in which C readily forms carbides by combining with V, Nb, Mo, Ti etc.

Silicon (Si) is an element necessary for securing strength, hardness and permanent fatigue resistance. The lower limit is set at 1.2% because strength and permanent fatigue resistance are insufficient at a lower content. Addition of a large amount of Si makes the steel hard, and also brittle, in which case breakage is likely to occur during coiling following oil-tempering. The upper limit is therefore set at 2.5% in order to prevent embrittlement after quenching/tempering.

Manganese (Mn) curbs strength reduction by fixing S present in the steel as MnS. The lower limit of Mn content is set at 0.1% to ensure adequate strength. The upper limit is set at 0.5%. The reason for this will be explained. When the Mn content is large, local supercooled structures tend to occur even during rolling prior to drawing. Although rolling is ordinarily conducted carefully so not to produce such supercooled structures, the likelihood of their sudden occurrence owing to the effect of microsegregation is great when the Mn content is high. Such supercooled structures become a cause of wire breakage in the ensuing wire drawing step. In the shaping or peeling step conducted prior to drawing, moreover, Mn aggravates the formation of surface layer martensite by the treatment heat. Mn is also an element that markedly affects the amount of residual austenite. Therefore, as the method of production explained later in this specification requires residual austenite after oil-tempering to be held to not greater than 6%, addition of a large amount to Mn is not permissible. In the present invention, the amount of Mn added to limit S content is set at the minimum amount for obtaining the required mechanical properties.

Chromium (Cr) improves quenching property and imparts temper-softening resistance. In the case of a steel subjected to nitriding, moreover, Cr combines with N to form nitrides and harden the steel. This effect is slight at a content of less than 0.4%. On the other hand, a content exceeding 2.0% leads to formation of Cr-system carbides that degrade fracture property. The Cr content is therefore defined as 0.4–2.0%.

Phosphorous (P) has a steel hardening effect but also segregates to cause steel embrittlement. In particular, it degrades intergranular strength, lowers the impact value and becomes a cause of delayed cracking and the like by permitting hydrogen invasion. A smaller P content is therefore better. The upper limit of P is therefore set at not more than 0.015%, the value above which embrittlement becomes pronounced.

Sulfur (S), like P, also causes steel embrittlement. Although this effect of S can be reduced by Mn, the resulting MnS assumes the form of inclusions that degrade the fracture property. S content must also be limited so that the amount of Mn added can be restricted to minimize the adverse effects of Mn addition. S content should therefore be held as low as possible and its upper limit is set at 0.015%, the value above which its adverse effects become pronounced.

Vanadium (V) can be added to enhance softening resistance. One particular technique frequently adopted recently for obtaining high-strength springs is nitriding treatment. The high temperature of 380–580° C. used in this treatment tends to decrease steel hardness. V is an effective element for preventing this decrease. This effect of V is substantially nil at a content of less than 0.05%. When V is present in excess of 0.4%, on the other hand, not all of it enters solid solution and coarse inclusions form and lower the steel toughness. Like Mn, V is also an element that affects formation of residual austenite. The amount of residual austenite can therefore not be held to 6% or less when the amounts of Mn and V added total more than 0.6%. Mn+V is therefore limited to not more than 0.6%.

Nickel (Ni) improves quenching property and enables stable strength enhancement by heat treatment. As Ni also improves ductility, it prevents breakage during cold coiling and improves spring fracture property. The effects of Ni are not observed at a content of less than 0.1% and saturate at a content exceeding 2.0%.

Titanium (Ti) and niobium (Nb) form nitrides and carbides that contribute to austenite grain refinement and precipitation hardening. These elements produce no observable effect at a content below 0.005% and when present in excess of 0.05% tend to remain as undissolved precipitates during heat treatment. The undissolved precipitates, which are large in size, tend to act as fracture starting points and do not contribute to austenite grain refinement and precipitation hardening.

Aluminum (Al) is an oxide forming element commonly used for deoxidization in steelmaking. However, when a large amount of Al is added to a high-strength steel to be fabricated to a small diameter, such as in a valve spring, the $Al_2O_3$ formed thereby tends to act as fracture starting points. The $Al_2O_3$ formed during steelmaking is not crushed because of soft property even after passing through rolling/drawing and tends to constitute an origin of stress concentration. As its deformation capability differs from that of the matrix, moreover, cracking is likely to occur under loading owing to the concentration of stress around the $Al_2O_3$. Since $Al_2O_3$ therefore tends to act as fracture starting points, it degrades the fracture strength of the spring. The Al should therefore be restricted.

Deoxidization is, however, essential in steelmaking by currently available technologies. Since addition of deoxidizing elements is therefore unavoidable, a method for reducing oxide size is needed. This can be achieved by forming a compound oxide including Al (e.g., Mn—Si—Al—system oxide) that is relatively soft. As such a compound oxide will be crushed and refined at the rolling and drawing stages, it will not form fracture starting points. Addition of a small amount of Al to soften the Mn-system and Si-system oxides is therefore preferable. The upper limit of Al content is set at 0.005% because coarse $Al_2O_3$ forms at higher contents. The lower limit of Al content is set at 0.0001% so that Al can be used for positive oxide softening. At a content of less than 0.0001%, soft oxides including Al are not formed and, instead, Si-system oxides form to degrade the fatigue strength.

Molybdenum (Mo) is an element that imparts softening resistance after quenching and tempering. It suppresses steel softening and imparts required strength, even if a high-temperature treatment such as nitriding is effected. At a content of less than 0.1%, Mo has little effect. At a content exceeding 2.0%, Mo forms a carbide in the steel that has the adverse effect of degrading the fracture property. The upper limit of Mo content is therefore defined as 0.1% and the lower limit thereof as 2.0%.

Nonmetallic inclusions consist of hard oxides, nitrides and sulfides. Large ones adversely affect fatigue strength. In the high-strength steel wire of this invention, whose tensile strength is 1960 MPa or greater, even small inclusions become fracture starting points. At the hardness level of the steel wire according to the present invention, the maximum size at which inclusions do not have an adverse effect is 15 $\mu$m. This is therefore set as the upper limit of inclusion size. Nonmetallic inclusion size, as defined for the purpose of the present invention, is determined by using an image-processing unit connected to an optical microscope to observe inclusions within an area of 2000 $mm^2$ of a longitudinal cross-section taken at a randomly selected portion of the steel wire and measuring the equivalent circular diameter of the largest nonmetallic inclusion observed.

A steel wire of sufficient strength to enable provision of a high-strength spring must have a tensile strength of not less than 1960 MPa. At a lower value, the performance of the coiled spring does not differ from that of one fabricated using a conventional steel wire. As pointed out earlier, however, the yield point of the steel wire must be taken into account from the viewpoint of spring fabricability during coiling. This is because cold forming of the spring is conducted by plastic deformation in the vicinity of room temperature so that, in the case of a steel whose plastic deformation starting stress and breaking stress are not greatly different, the forming has to be conducted in a stress load state just short of breakage. Under such condition, the coiling property is poor because the probability of breakage owing to slight fluctuation, bruising and the like during fabrication becomes extremely high.

The coiling property of a steel can therefore be considered to improve with increasing difference between its plastic deformation starting stress and breaking stress. Through an investigation conducted with this in mind, it was found that, where yield ratio is used as an index of the difference between plastic deformation starting stress and breaking stress, it suffices to set the yield ratio at not greater than 0.9 in the case of a tensile strength of 1960 MPa. On the other hand, when the yield ratio is less than 0.8, sufficient permanent fatigue property is not manifested. The yield ratio must therefore be not less than 0.8. It should be noted however that these limits are not absolute but vary as a function of the amount of residual austenite. When the amount of residual austenite is less than 6%, cold coiling is possible even at a yield ratio greater than 0.9.

The yield ratio ($\sigma_{0.2}/\sigma_B$)defined in the present invention will be explained. $\sigma_{0.2}$ is the value obtained by using the offset method to calculate load at a permanent elongation of 0.2% under the yield stress prescribed by JIS Z 2241 (standard set in 1993) and dividing the result by the original cross-sectional area of the test piece. $\sigma_B$ is the value obtained by dividing the maximum tensile stress at the tensile strength prescribed by JIS Z 2241 by the original cross-sectional area of the test piece. The ratio of $\sigma_{0.2}$ to $\sigma_B$ ($\sigma_{0.2}/\sigma_B$) is called the yield ratio.

The reason for defining the amount of residual austenite as not greater than 6% will be explained. Residual austenite usually remains at segregation sites and in the vicinity of the old austenite grain boundaries. Although residual austenite becomes martensite through working-induced transformation, it was found that induced transformation, occurring during spring fabrication, works instead to degrade a spring coiling property by producing local sites of high hardness in the steel. Moreover, it has recently become the practice to surface-harden springs by a plastic deformation treatment such as shot peening or scragging. When the fabrication process includes multiple plastic deformation steps in this manner, the working-induced martensite formed at early stages lowers the fracture strain, thereby degrading the workability and/or the fracture property of the spring during use. When bruises or other industrially unavoidable deformations are introduced, moreover, breakage readily occurs during coiling. Workability is therefore enhanced by minimizing residual austenite to curb formation of working-induced martensite.

The method of producing the steel wire will now be explained. The heating temperature is defined as not less than 920° C. because the spring steel must be heated to a temperature that is high enough not only to enable austenite formation but also to thoroughly dissolve precipitates. This is necessary because the precipitates formed by Mo, V, Ti, Nb etc. will remain as undissolved precipitates if the solution treatment prior to quenching is insufficient. Undissolved precipitates become fracture starting points during coiling and do not contribute to precipitation hardening because they enlarge to reduce the number of precipitates. The effect of the undissolved precipitates is thus counter to the purpose for which the elements were added in the first place. They must therefore be paid careful attention during the heat treatment. It was found that, as a rule of thumb, precipitation hardening and prevention of breakage during coiling can be effectively enhanced by making the amount to Mo, V, Ti and Nb system precipitates entering solid solution not less than 0.1%.

The amount of solid-solution Mo, V, Ti and Nb system precipitates will be discussed in further detail. V has good affinity for carbon and nitrogen and forms compounds of a basic composition represented as MC type. In the austenite region, their forms change with heating. Examining the behavior of undissolved carbides, taking V as an example, $V_4C_3$ precipitates to produce precipitation hardening in the course of quenching/tempering.

$$V_4C_3=4V_\gamma+3C_\gamma(C=0.5\%) \quad (1)$$

$$\log[\%V]_\gamma[\%C]_\gamma=-(30400/T)+20.88 \quad (2)$$

Although other forms of carbides and nitrides, such as VC and VN, also exist, they will not be discussed in detail here, and only a general analysis will be made. The amount of solid-solution carbon at any given heating temperature can be calculated from these equations. It will be noted that temperature is an extremely important factor. The equations assume an equilibrium state. The amount of solid-solution carbon is considered to be even less in the actual short-period heating. Similar relationships are also known to hold for Nb and Ti.

$$NbC=Nb_\gamma+C_\gamma \quad (3)$$

$$\log[\%Nb]_\gamma[\%C]_\gamma=-(7970/T)+3.31 \quad (4)$$

$$TiC=Ti_\gamma+C_\gamma(C=0.5\%) \quad (5)$$

$$\log[\%Ti]_\gamma[\%C]_\gamma=-(10475/T)+4.68 \quad (6)$$

These equations also show that the amount of each of the added elements entering solid solution increases with increasing heating temperature. While no corresponding formula is available for Mo owing to the complexity of its oxide forms, the amount of Mo entering solid solution also increases with increasing temperature. On the other hand, the yield point falls with increasing heating temperature. In the notched-specimen bending test (in which the bending angle up to which a notched specimen can be bent before breaking is measured), which is used to evaluate the ductility of spring steel with a flaw, the bending angle is found to increase, i.e., the coiling property is found to improve, with decreasing yield point.

In light of the foregoing findings, the inventors conducted a study regarding the heating temperature and found that the properties set out regarding the first to sixth aspects of the invention can be achieved by subjecting a steel of the chemical composition defined in any of the first to fifth aspects of the invention to heat treatment at a heating temperature of not less than 920° C.

A method of producing the steel wire that enables the amount of residual austenite to be held to not greater than 6% will now be explained. Oil-tempered wire is produced in a continuous three-step process of heating, quenching and tempering that starts with the wire-drawn steel and ends with austenite formation. Generation of residual austenite is affected by three conditions: amount of alloy elements entering solid solution, wire temperature during quenching, and tempering. Specifically, when those of the alloying elements that act as austenite stabilizing elements, namely, carbon, Mn, Ni and Mo, enter the austenite in solid solution, residual austenite is readily formed. Moreover, when alloying elements are added, the Ms point and Mf point decrease, do not fall below the Mf point at the quenching temperature by an ordinary quenching catalyzer, martensite is not completely formed, and residual austenite readily occurs.

The residual austenite that occurs is decomposed in the following tempering step. When the tempering temperature is set low or the tempering period is made short so as to obtain high strength, however, the decomposition is incomplete and austenite remains in the steel wire. Although the amount of residual austenite generated can be easily reduced by adding only small amounts of the alloying elements, this is not a feasible solution in the present invention because the added elements prescribed by the first to fifth aspects of the invention are indispensable for increasing softening resistance and obtaining high strength. The inventors discovered that, in order to hold the amount of residual austenite to not greater than 6% when oil-tempering a steel of the chemical composition defined in any of the first to fifth aspects of the invention, it is important to set the quenching temperature as low as possible and to effect thorough cooling. Specifically, the inventors found that good results can be obtained by making the temperature of the wire at quenching not greater than 45° C.

EXAMPLE

Table 1 shows the chemical compositions of steels according to the present invention and of comparison steels. The invention steels made to have these chemical compositions were hot-rolled into 8 mm-diameter wire rods and subjected to patenting, scalping, drawing and oil-tempering to obtain 3.2 mm-diameter oil-tempered wires. No wire breakage or other problems were experienced during drawing. The tensile strengths of the oil-tempered wires were made not less than 1960 MPa so as to ensure the strength needed for fatigue resistance and permanent fatigue resistance. The inclusion sizes shown in Table 1 are the results of measurements made near the surface layer.

Table 2 shows the heat treatment conditions and the mechanical properties of the oil-tempered wires composed of the invention steels and comparative steels. The oil-tempered wires of the invention steels were heated to higher temperatures than the comparative steels in order to avoid undissolved carbonitrides of V, Mo, Ti, Nb etc. In addition, the quenching temperature in the invention examples was made not greater than 45° C. in order to obtain a yield ratio of 0.8–0.9 and suppress the amount of residual austenite, thereby enabling spring formation to be conducted without breakage. The tempering temperature was set higher in the invention examples so as to promote decomposition of the residual austenite produced, i.e., to reduce the amount of residual austenite to not greater than 6%. In order to lower the deformation resistance during spring formation, the yield ratio was regulated to not less than 0.8 and not more than 0.9.

As an oil-tempered wire increases in strength, it rises in notch sensitivity and is more likely to break starting from a small flaw during forming. The spring fabricability of each oil-tempered wire was evaluated by subjecting it to a notched-specimen bending test. This test was conducted prior to spring formation by forcing a high-alloy chip against the oil-tempered wire to notch it to a depth of 25 $\mu$m, subjecting the side opposite the notch to three-point bending using a 6.5 mm-radius punch so as to apply tensile stress to the notch, and measuring the bending angle up to breakage.

Figure 2:
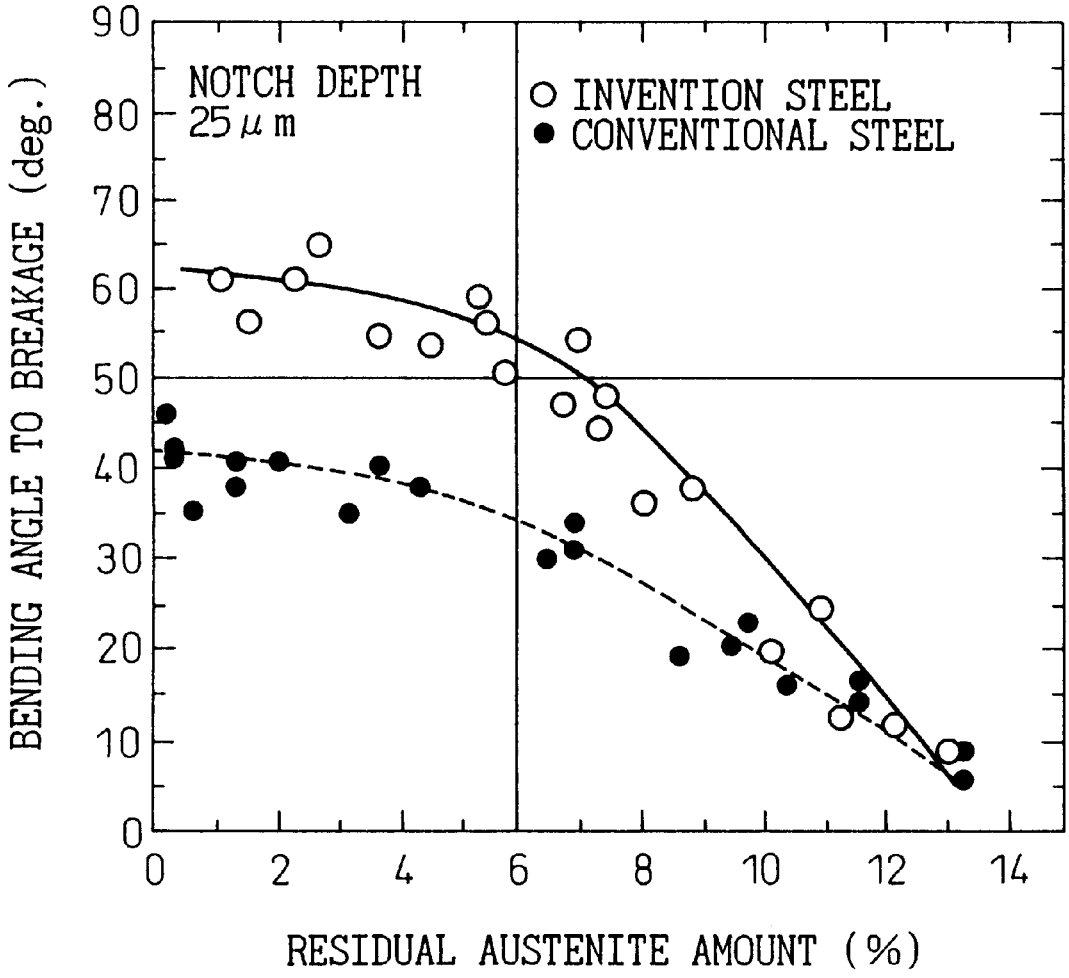
FIG. 2 is a graph showing how bending workability varies as a function of amount of residual austenite.

FIG. 1 shows how the notched-specimen bending angle varied as a function of heating temperature during oil tempering in the case of the invention steels and the comparative steels. FIG. 2 shows how the notched-specimen bending angle varied as a function of amount of residual austenite. The invention steels exhibited a better notched-specimen bending property and a greater improvement in workability with increasing heating temperature than the conventional high-strength steels. The invention steels were also superior to the conventional steels in the relationship between notched-specimen bending property and amount of residual austenite and exhibited particularly outstanding workability when the amount of residual austenite was 6% or less.

In light of these relationships, Table 2 shows the optimum oil-tempering conditions, yield ratio, amount of residual austenite, spring fabricability, fatigue property and permanent fatigue property for each of the component systems. The ratings in the column of Table 2 headed "Fabricability rating" represent the evaluated breakage (breaking rate) during formation (coiling). ○ indicates a breakage rate of less than 0.001%, Δ a breakage rate of 0.001–1%, and X a breakage rate of greater than 1%. The values in the "Fatigue property" column indicate time-strength for $5\times10^7$ times and stress amplitude from average load stress of 686 MPa. Amplitudes of 450 MPa or greater were rated ○ (good) and of less than 450 MPa were rated X (poor). The values in the "Permanent fatigue property" column indicate ratings in terms of residual shearing strain. Residual strain stain of $3.5\times10^4$ or less was rated ○ (good) and of greater than this X (poor).

Table 3 shows the specifications of fabricated springs. Evaluation of spring fabricability and evaluation of fatigue resistance and permanent fatigue resistance were conducted using two types of springs. The springs of specifications (1) were used to rate fatigue resistance and permanent fatigue resistance and the springs of specifications (2) were used to rate spring fabricability during cold fabrication. The evaluation results are shown in Table 2. The springs of specifications (1) were tested after being subjected to nitriding and shot peening. The oil-tempered wires of conventional steels that exhibited good spring fabricability were inferior in fatigue strength and permanent fatigue resistance. In contrast, the oil-tempered wires of the invention steels did not break during spring formation and were as good as or better than those of the comparison steels in fatigue resistance and permanent fatigue resistance.

Figure 3:
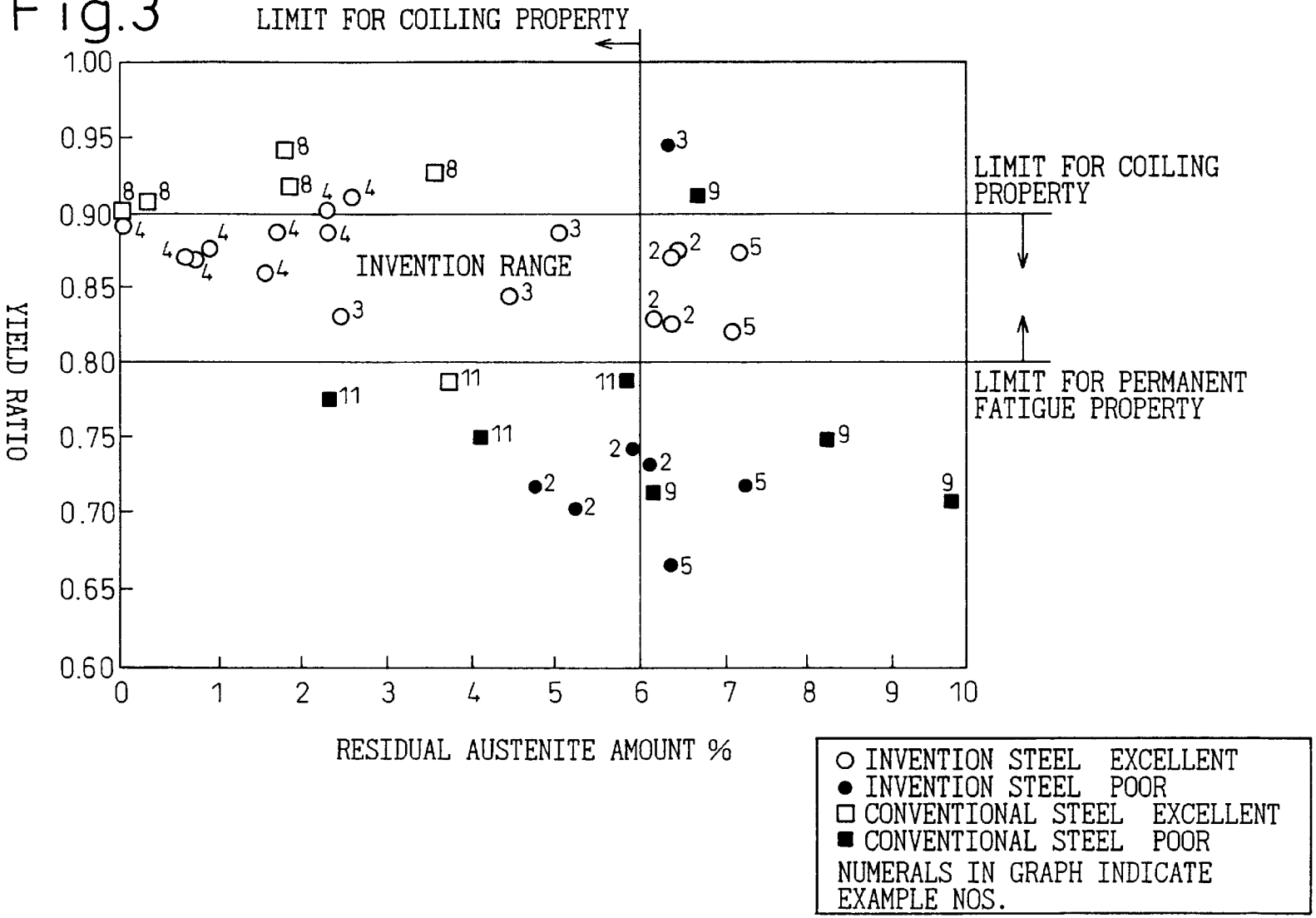
FIG. 3 is a diagram showing residual austenite and yield ratio ranges defined by the present invention.

FIG. 3 shows the relationship between amount of residual austenite and yield ratio in the case where steels of the chemical compositions indicated for Examples 2–5, 8 and 9 in Table 1 were heat-treated so as to vary their amount of residual austenite and yield ratio. The numerals inside the graph indicate Example Nos. In all cases, quenching was started from a temperature of 960° C. and tempering was effected at 420–500° C. Regarding Example 8, however, in the case of this comparison, quenching was experimentally effected at 5° C. or less to thoroughly promote transformation before tempering.

Permanent fatigue property and coiling property were evaluated. Examples designated ○ and □ could be coiled and exhibited good permanent fatigue property. Examples designated ■ and ● were poor in coiling property and were insufficient in permanent fatigue resistance. When the chemical composition falls outside the invention range, as in the case of Example 8, the amount of residual austenite and the yield ratio can be brought into the ranges defined by the present invention only by introducing an industrially unacceptable method, such as that of setting the quenching temperature extremely low. When the chemical composition falls outside the invention range, as in the case of Examples 9 and 11, industrial processing is difficult because it is difficult to achieve the residual austenite amount and yield ratio according to the invention by effecting ordinary processing.

Figure 4:
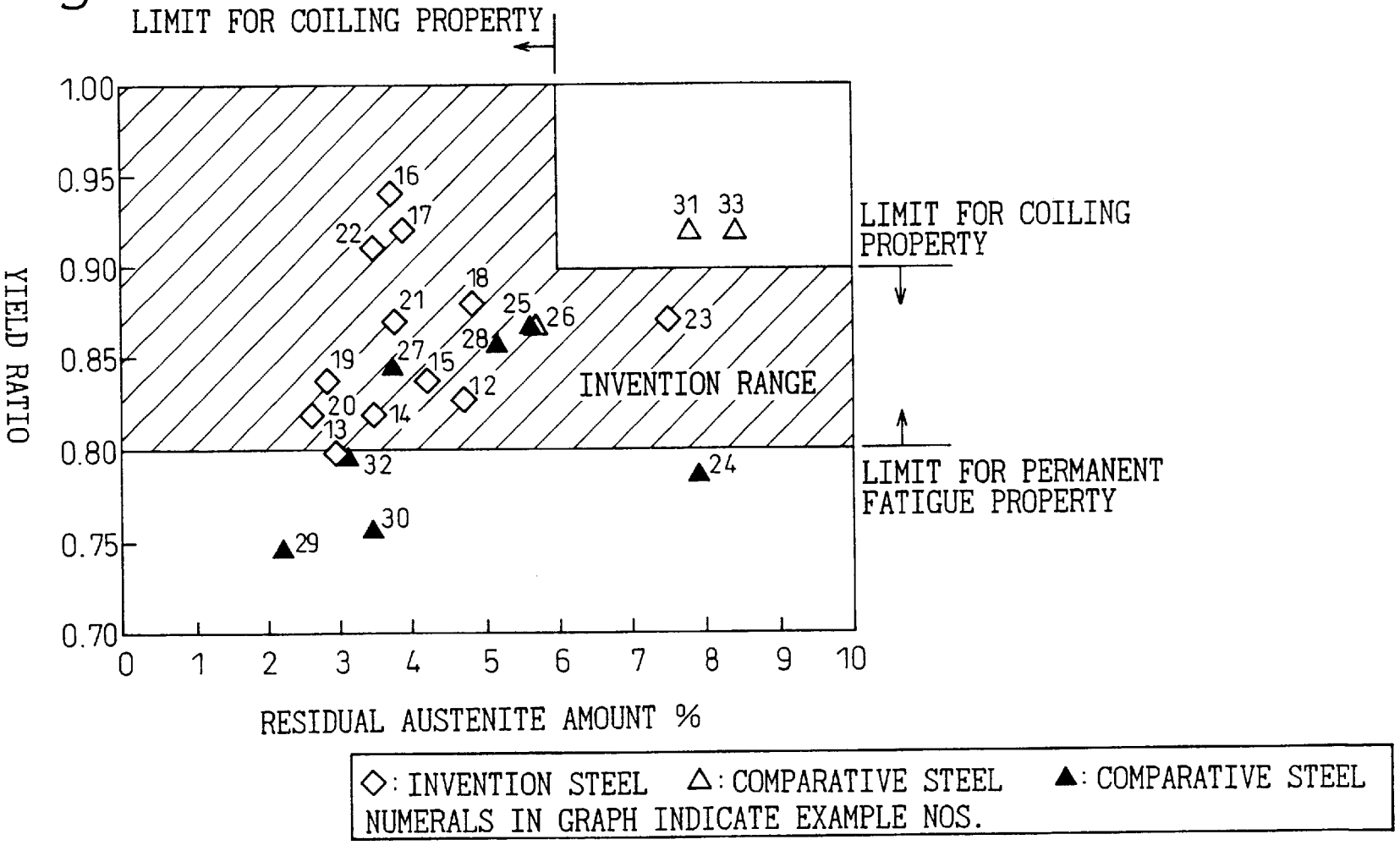
FIG. 4 is a diagram showing residual austenite and yield ratio ranges defined by the present invention.

Tables 4 and 5 show Examples in which various additional chemical compositions were studied. FIG. 4 shows the relationship between yield ratio and amount of residual austenite in the Examples of Tables 4 and 5. In this figure, ◇ designates invention example. Δ and ▲ designates comparative example. Δ designates comparative example judged to be high in the breakage probability during spring forming. Δ designates comparative example judged to be poor in fatigue property or permanent fatigue property. When subjected to the notched-specimen bending test described earlier, the oil-tempered wires made of invention steels were found to exhibit excellent workability notwithstanding their high tensile strengths of 1960 MPa or greater.

Examples 27 and 28 had inclusion sizes larger than the upper limit specified by the present invention and were poor in fatigue property. Examples 29–31 and 33 fell outside the yield ratio or residual austenite ranges. Examples 29 and 30 were poor in fatigue property and permanent fatigue property and Examples 31 and 33 were poor in spring fabricability. Examples 25 and 26, whose P and S contents exceeded the invention limits, were poor in fatigue property. Examples 23, 24, 29, 30 and 31 were inferior to the invention examples in both fatigue property and permanent fatigue resistance. Example 32 had a chemical composition within the invention range but was insufficient in strength and poor in fatigue strength.

The present invention can, independently of chemical composition, achieve both excellent workability and spring performance by effecting heat treatment for controlling the yield ratio and the amount of residual stress to those indicated in the invention examples. However, unless the steel used has a chemical composition as defined by the present invention, i.e., a composition suitably designed to ensure good fatigue property and permanent fatigue resistance, production of a steel wire satisfying the requirements for both practical workability and practical spring performance is not possible by industrial heat treatment.

TABLE 1

| Example | | C | Si | Mn | P | S | Ni | Cr | Mo | V | Ti | Nb | Al | Inclusion size μm | Ms point | Mf point |
|---|---|---|---|---|---|---|---|---|---|---|---|---|---|---|---|---|
| 1 | Invention | 0.50 | 2.02 | 0.39 | 0.006 | 0.006 | 0.01 | 0.79 | 0.09 | 0.09 | — | — | 0.0009 | 10 | 292 | 62 |
| 2 | steels | 0.65 | 2.04 | 0.41 | 0.007 | 0.006 | 0.02 | 1.22 | 0.10 | 0.10 | — | — | 0.0008 | 13 | 213 | −17 |
| 3 | | 0.64 | 2.02 | 0.41 | 0.006 | 0.006 | 0.02 | 0.81 | 0.10 | 0.10 | — | — | 0.0010 | 9 | 224 | −6 |
| 4 | | 0.51 | 20.3 | 0.42 | 0.006 | 0.006 | 0.51 | 0.81 | 0.10 | 0.10 | — | — | 0.0011 | 12 | 277 | 47 |
| 5 | | 0.64 | 2.02 | 0.42 | 0.006 | 0.006 | 0.50 | 1.20 | 0.10 | 0.10 | — | — | 0.0007 | 12 | 209 | −21 |
| 6 | | 0.65 | 2.03 | 0.42 | 0.007 | 0.008 | 0.02 | 1.18 | 0.09 | 0.09 | 0.02 | — | 0.0011 | 11 | 214 | −17 |
| 7 | Comparative | 0.55 | 1.42 | 0.68 | 0.013 | 0.007 | 0.01 | 0.68 | — | — | — | — | 0.0012 | 11 | 266 | 36 |
| 8 | steels | 0.65 | 1.45 | 0.69 | 0.008 | 0.008 | 0.02 | 0.69 | — | 0.20 | — | — | 0.0011 | 12 | 193 | −38 |
| 9 | | 0.76 | 1.45 | 0.56 | 0.017 | 0.009 | 0.01 | 0.52 | 0.16 | 0.47 | — | — | 0.0015 | 9 | 158 | −72 |
| 10 | | 0.63 | 1.35 | 0.70 | 0.011 | 0.011 | 0.01 | 1.50 | 0.50 | 0.20 | — | — | 0.0010 | 13 | 220 | −10 |
| 11 | | 0.73 | 2.01 | 0.75 | 0.008 | 0.009 | 0.02 | 1.02 | 0.22 | 0.36 | — | 0.02 | 0.0009 | 10 | 158 | −75 |

TABLE 2

| Example | | Heating temperature ° C. | Heating time sec | Quenching temp. ° C. | Quenching time sec | Tempering temp. ° C. | Tempering time sec | Tensile strength MPa | Yield ratio $\sigma_{0.2}/\sigma_B$ | Residual austenite amount % | Bending angle deg. | Formability rating | Fatigue property amplitude MPa | Permanent fatigue property Residual shearing strain |
|---|---|---|---|---|---|---|---|---|---|---|---|---|---|---|
| 1 | In- | 950 | 144 | 45 | 35 | 460 | 58 | 1978 | 0.89 | 1.8 | 58 | ○ | ○686 ± 482 | ○$3.1 \times 10^{-4}$ |
| 2 | vention | 950 | 144 | 40 | 35 | 480 | 58 | 2152 | 0.81 | 5.7 | 60 | ○ | ○686 ± 508 | ○$2.5 \times 10^{-4}$ |
| 3 | steels | 950 | 144 | 40 | 35 | 480 | 58 | 2062 | 0.83 | 2.6 | 65 | ○ | ○686 ± 482 | ○$2.9 \times 10^{-4}$ |
| 4 | | 950 | 144 | 45 | 35 | 460 | 58 | 2014 | 0.89 | 2.5 | 62 | ○ | ○686 ± 473 | ○$3.0 \times 10^{-4}$ |
| 5 | | 950 | 144 | 40 | 35 | 460 | 58 | 2202 | 0.83 | 5.9 | 51 | ○ | ○686 ± 501 | ○$2.8 \times 10^{-4}$ |
| 6 | | 950 | 144 | 40 | 35 | 460 | 58 | 2225 | 0.83 | 5.8 | 57 | ○ | ○686 ± 482 | ○$2.7 \times 10^{-4}$ |
| 7 | Compara- | 900 | 112 | 60 | 30 | 442 | 48 | 1963 | 0.91 | 0.3 | 58 | ○ | X686 ± 423 | X$11.4 \times 10^{-4}$ |
| 8 | tive | 900 | 122 | 60 | 30 | 440 | 49 | 2049 | 0.92 | 2.0 | 41 | ○ | X686 ± 441 | X$6.5 \times 10^{-4}$ |
| 9 | steels | 930 | 128 | 60 | 30 | 475 | 51 | 2116 | 0.95 | 6.5 | 24 | Δ | ○686 ± 490 | ○$3.1 \times 10^{-4}$ |

TABLE 2-continued

| Example | Heating temperature ° C. | Heating time sec | Quenching temp. ° C. | Quenching time sec | Tempering temp. ° C. | Tempering time sec | Tensile strength MPa | Yield ratio $\sigma_{0.2}/\sigma_B$ | Residual austenite amount % | Bending angle deg. | Formability rating | Fatigue property amplitude MPa | Permanent fatigue property Residual shearing strain |
|---|---|---|---|---|---|---|---|---|---|---|---|---|---|
| 10 | 930 | 176 | 60 | 42 | 530 | 70 | 2202 | 0.93 | 3.7 | 28 | Δ | ○686 ± 501 | ○$2.9 \times 10^{-4}$ |
| 11 | 950 | 176 | 60 | 42 | 490 | 51 | 2275 | 0.71 | 9.7 | 21 | X | ○686 ± 508 | ○$2.6 \times 10^{-4}$ |

TABLE 3

| Item | Springs specs. (1) | Springs specs. (2) |
|---|---|---|
| Wire diameter mm | 3.20 | 3.20 |
| Average coil diameter mm | 21.2 | 13.2 |
| Total turns | 6.5 | 12 |
| Free height mm | 50.0 | 85 |
| Spring index | 6.615 | 4.125 |

TABLE 4

| Example | | C | Si | Mn | P | S | Ni | Cr | Mo | V | Ti | Nb | Al | Inclusion size μm |
|---|---|---|---|---|---|---|---|---|---|---|---|---|---|---|
| 12 | Invention steels | 0.65 | 1.98 | 0.35 | 0.009 | 0.009 | — | 1.32 | — | — | — | — | 0.0010 | 10 |
| 13 | | 0.58 | 1.76 | 0.30 | 0.008 | 0.004 | — | 0.76 | 0.24 | — | — | — | 0.0012 | 8 |
| 14 | | 0.57 | 2.01 | 0.29 | 0.005 | 0.003 | — | 0.01 | — | 0.21 | — | — | 0.0010 | 11 |
| 15 | | 0.55 | 1.99 | 0.29 | 0.004 | 0.007 | — | 0.81 | — | 0.10 | — | — | 0.0010 | 10 |
| 16 | | 0.65 | 2.00 | 0.31 | 0.006 | 0.005 | — | 1.05 | 0.10 | 0.10 | — | — | 0.0008 | 8 |
| 17 | | 0.65 | 2.02 | 0.31 | 0.006 | 0.005 | — | 1.25 | 0.10 | 0.11 | — | — | 0.0009 | 9 |
| 18 | | 0.65 | 1.98 | 0.30 | 0.005 | 0.006 | 0.20 | 1.03 | 0.11 | 0.12 | — | — | 0.0008 | 10 |
| 19 | | 0.61 | 1.98 | 0.28 | 0.012 | 0.005 | — | 1.12 | — | — | — | 0.02 | 0.0009 | 11 |
| 20 | | 0.55 | 1.59 | 0.31 | 0.007 | 0.006 | — | 0.60 | 0.45 | 0.08 | — | — | 0.0011 | 12 |
| 21 | | 0.65 | 1.59 | 0.28 | 0.009 | 0.005 | — | 0.81 | — | 0.10 | — | 0.05 | 0.0007 | 9 |
| 22 | | 0.55 | 1.59 | 0.20 | 0.009 | 0.004 | — | 1.51 | — | 0.30 | — | — | 0.0035 | 11 |
| 23 | | 0.63 | 2.01 | 0.35 | 0.007 | 0.008 | — | 0.75 | — | — | — | — | 0.0010 | 10 |
| 24 | Comparative steels | 0.50 | 0.88 | 0.42 | 0.007 | 0.004 | — | 1.05 | — | — | — | — | 0.0011 | 12 |
| 25 | | 0.57 | 1.78 | 0.48 | 0.019 | 0.010 | — | 0.98 | — | 0.10 | — | — | 0.0010 | 9 |
| 26 | | 0.61 | 1.57 | 0.35 | 0.011 | 0.021 | — | 0.77 | 0.10 | — | — | — | 0.0009 | 11 |
| 27 | | 0.61 | 1.97 | 0.42 | 0.008 | 0.006 | — | 0.75 | 0.10 | — | — | — | 0.0115 | 21 |
| 28 | | 0.59 | 1.56 | 0.52 | 0.008 | 0.004 | — | 0.11 | — | — | — | — | 0.0013 | 25 |
| 29 | | 0.52 | 1.82 | 0.77 | 0.008 | 0.007 | — | 0.79 | — | 0.20 | — | — | 0.0011 | 12 |
| 30 | | 0.57 | 2.11 | 0.49 | 0.009 | 0.008 | — | 0.49 | — | — | — | — | 0.0010 | 11 |
| 31 | | 0.61 | 2.01 | 0.45 | 0.010 | 0.009 | 0.30 | 0.89 | — | — | — | — | 0.0010 | 12 |
| 32 | | 0.55 | 1.64 | 0.40 | 0.005 | 0.004 | — | 0.76 | — | 0.11 | — | — | 0.0012 | 11 |
| 33 | | 0.65 | 2.02 | 0.31 | 0.006 | 0.005 | — | 1.25 | 0.10 | 0.10 | — | — | 0.0009 | 9 |

TABLE 5

| Example | | Heating temperature ° C. | Heating time sec | Quenching temp. ° C. | Quenching time sec | Tempering temp. ° C. | Tempering time sec | Tensile strength MPa | Yield ratio $\sigma_{0.2}/\sigma_B$ | Residual austenite amount % | Bending angle deg. | Formability rating | Fatigue property amplitude MPa | Permanent fatigue property Residual shearing strain |
|---|---|---|---|---|---|---|---|---|---|---|---|---|---|---|
| 12 | Invention steels | 935 | 144 | 45 | 35 | 480 | 58 | 2155 | 0.83 | 4.7 | 54 | ○ | ○686 ± 499 | ○$2.1 \times 10^{-4}$ |
| 13 | | 935 | 144 | 40 | 35 | 470 | 58 | 2135 | 0.80 | 2.9 | 65 | ○ | ○686 ± 506 | ○$1.9 \times 10^{-4}$ |
| 14 | | 950 | 144 | 45 | 35 | 450 | 58 | 2067 | 0.82 | 3.5 | 62 | ○ | ○686 ± 498 | ○$2.7 \times 10^{-4}$ |
| 15 | | 950 | 144 | 40 | 35 | 450 | 58 | 2101 | 0.84 | 4.2 | 65 | ○ | ○686 ± 496 | ○$3.0 \times 10^{-4}$ |
| 16 | | 950 | 144 | 40 | 35 | 450 | 58 | 2209 | 0.94 | 3.7 | 52 | ○ | ○686 ± 510 | ○$2.6 \times 10^{-4}$ |
| 17 | | 950 | 144 | 45 | 35 | 460 | 58 | 2172 | 0.92 | 3.9 | 55 | ○ | ○686 ± 508 | ○$2.5 \times 10^{-4}$ |
| 18 | | 950 | 144 | 40 | 35 | 460 | 58 | 2168 | 0.88 | 4.8 | 58 | ○ | ○686 ± 509 | ○$2.7 \times 10^{-4}$ |
| 19 | | 935 | 144 | 40 | 35 | 460 | 58 | 2138 | 0.84 | 2.8 | 62 | ○ | ○686 ± 501 | ○$2.7 \times 10^{-4}$ |
| 20 | | 950 | 144 | 40 | 35 | 440 | 58 | 2015 | 0.82 | 2.6 | 66 | ○ | ○686 ± 487 | ○$2.9 \times 10^{-4}$ |
| 21 | | 950 | 144 | 45 | 35 | 460 | 58 | 2182 | 0.87 | 3.8 | 52 | ○ | ○686 ± 495 | ○$3.2 \times 10^{-4}$ |

TABLE 5-continued

| Example | | Heating temperature ° C. | Heating time sec | Quenching temp. ° C. | Quenching time sec | Tempering temp. ° C. | Tempering time sec | Tensile strength MPa | Yield ratio $\sigma_{0.2}/\sigma_B$ | Residual austenite amount % | Bending angle deg. | Formability rating | Fatigue property amplitude MPa | Permanent fatigue property Residual shearing strain |
|---|---|---|---|---|---|---|---|---|---|---|---|---|---|---|
| 22 | | 950 | 144 | 40 | 35 | 440 | 58 | 2090 | 0.91 | 3.5 | 57 | ○ | ○686 ± 500 | ○3.1 × $10^{-4}$ |
| 23 | | 930 | 122 | 45 | 35 | 460 | 58 | 2171 | 0.87 | 7.5 | 41 | ○ | ○686 ± 502 | ○3.0 × $10^{-4}$ |
| 24 | Comparative steels | 950 | 144 | 40 | 35 | 480 | 58 | 2118 | 0.79 | 7.9 | 38 | ○ | X686 ± 426 | X6.3 × $10^{-4}$ |
| 25 | | 950 | 144 | 40 | 35 | 460 | 58 | 2192 | 0.87 | 5.6 | 40 | ○ | X686 ± 440 | ○2.4 × $10^{-4}$ |
| 26 | | 950 | 144 | 40 | 35 | 460 | 58 | 2188 | 0.87 | 5.6 | 48 | ○ | X686 ± 432 | ○2.6 × $10^{-4}$ |
| 27 | | 950 | 144 | 45 | 35 | 460 | 58 | 2178 | 0.85 | 3.7 | 55 | ○ | X686 ± 435 | ○3.1 × $10^{-4}$ |
| 28 | | 950 | 144 | 40 | 35 | 460 | 58 | 2196 | 0.86 | 5.1 | 59 | ○ | X686 ± 433 | ○3.0 × $10^{-4}$ |
| 29 | | 950 | 144 | 80 | 42 | 490 | 51 | 2005 | 0.75 | 2.2 | 52 | ○ | X686 ± 419 | X7.4 × $10^{-4}$ |
| 30 | | 950 | 144 | 80 | 42 | 490 | 51 | 1986 | 0.76 | 3.5 | 62 | ○ | X686 ± 410 | X8.1 × $10^{-4}$ |
| 31 | | 950 | 144 | 80 | 35 | 460 | 58 | 2086 | 0.92 | 7.8 | 21 | X | X686 ± 406 | X9.9 × $10^{-4}$ |
| 32 | | 950 | 144 | 45 | 35 | 480 | 58 | 1850 | 0.80 | 3.1 | 69 | ○ | X686 ± 401 | ○2.8 × $10^{-4}$ |
| 33 | | 900 | 122 | 60 | 30 | 440 | 49 | 2070 | 0.92 | 8.4 | 25 | X | ○686 ± 465 | ○2.9 × $10^{-4}$ |

As explained in the foregoing, the present invention provides an oil-tempered wire that exhibits a high strength of not less than 1960 MPa and that, moreover, enables spring fabrication to be conducted without breakage during cold spring formation. Therefore, by subjecting the formed spring to strain relieving annealing, nitriding and shot peening, a spring can be produced that exhibits fatigue resistance and permanent fatigue resistance that are as good as or better than those of springs made of conventional steels.

What is claimed is:

1. A steel wire for high strength springs comprising as steel components, in weight percent,

| | |
|---|---|
| C | 0.4–0.7% |
| Si | 1.2–2.5% |
| Mn | 0.1–0.42% |
| Cr | 0.4–2.0% |
| Al | 0.0001–0.005% and |
| V | 0.050–0.4%, |
| | Mn + V being not more than 0.6%, being limited to |
| P | not more than 0.015% and |
| S | not more than 0.015%, |

the balance being Fe and unavoidable impurities, the steel wire having no nonmetallic inclusions of a size greater than 15 $\mu$m, a tensile strength of not less than 1960 MPa, and a yield ration ($\sigma_{0.2}/\sigma_B$) of not less than 0.8 and not greater than 0.9 or a yield ration ($\sigma_{0.2}/\sigma_B$) of not less than 0.8 and an amount of residual austenite of not greater than 6%.

2. A steel wire for high-strength springs according to claim 1, comprising in addition to the defined chemical components, in weight percent, Ni: 0.1–2.0%, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6% by weight.

3. A steel wire for-high-strength springs according to claim 1, comprising in addition to the defined chemical components, in weight percent, Mo: 0.1–2.0%, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6% by weight.

4. A steel wire for high-strength springs according to claim 1, comprising, in addition to the defined chemical components, in weight percent, one or both of Nb: 0.005–0.05% and Ti: 0.005–0.05%, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6% by weight.

5. A method of producing a steel wire for high strength springs comprising: subjecting the steel wire having the composition of claim 1 to heat treatment by heating the steel wire at a temperature of not less than 920° C. and quenching the heat treated steel wire to a temperature of not greater than 45° C. to obtain a steel wire having no nonmetallic inclusions of a size greater than 15 $\mu$m. a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6% by weight.

6. A steel wire for high-strength springs comprising as steel components, in weight percent,

| | |
|---|---|
| C | 0.4–0.7% |
| Si | 1.2–2.5% |
| Mn | 0.1–0.42% |
| Cr | 0.4–2.0% |
| Al | 0.0001–0.005% and |
| V | 0.050–0.4%, |
| | Mn + V being not more than 0.6%, being limited to |

-continued

| | |
|---|---|
| P | not more than 0.015% and |
| S | not more than 0.015%, |

the balance being Fe and unavoidable impurities, the steel wire having no nonmetallic inclusions of a size greater than 15 $\mu$m, a tensile strength of not less than 1960 MPa, and a yield ratio ($\sigma_{0.2}/\sigma_B$) of not less than 0.8 and not greater than 0.9 or a yield ratio ($\sigma_{0.2}/\sigma_B$) of not less than 0.8 and an amount of residual austenite of not greater than 6% by weight;

said steel wire for high-strength springs being produced by a method comprising:

subjecting the steel wire to heat treatment by heating the steel wire at a temperature of not less than 920° C. and quenching the heat treated steel wire to a temperature of not greater than 45° C.

* * * * *